US006237205B1

(12) United States Patent
Yoshimura et al.

(10) Patent No.: US 6,237,205 B1
(45) Date of Patent: May 29, 2001

(54) REVERSING COLD ROLLING APPARATUS

(75) Inventors: Yoshitaka Yoshimura; Hiroyuki Kaito; Akira Umetsu, all of Tokyo (JP)

(73) Assignee: Kawasaki Steel Corporation, Kobe (JP)

( * ) Notice: Subject to any disclaimer, the term of this patent is extended or adjusted under 35 U.S.C. 154(b) by 0 days.

(21) Appl. No.: 09/440,717

(22) Filed: Nov. 16, 1999

(51) Int. Cl.[7] ..... B23P 23/00; B21B 1/36

(52) U.S. Cl. ..... 29/33 Q; 72/229; 72/365.2; 29/33 S

(58) Field of Search ..... 29/33 Q, 33 R, 29/33 S, 33 B; 72/229, 40, 39; 164/441, 476, 477, 428, 454; 148/529

(56) References Cited

U.S. PATENT DOCUMENTS

| | | | | |
|---|---|---|---|---|
| 4,123,011 | | 10/1978 | Kajiwara et al. . | |
| 4,710,240 | * | 12/1987 | Frommann | 29/33 CV X |
| 5,335,713 | * | 8/1994 | Hoppmann et al. | 164/441 |
| 5,495,736 | * | 3/1996 | Nishi et al. | 72/39 |

FOREIGN PATENT DOCUMENTS

| | | | | |
|---|---|---|---|---|
| 0-577-345-A1 | | 1/1994 | (EP) . | |
| 60-145205 | | 7/1985 | (JP) . | |
| 63-104715 | * | 5/1988 | (JP) | 29/33 C |
| 9-85308 | | 3/1997 | (JP) . | |
| 11-169942 | | 6/1999 | (JP) . | |

* cited by examiner

*Primary Examiner*—William Briggs
(74) *Attorney, Agent, or Firm*—Oliff & Berridge, PLC.

(57) ABSTRACT

Various conventional problems produced by the reason that the coil preparatory line and the reversing cold rolling line are independent of each other are to be solved by unifying the both lines without reducing efficiency of rolling operation. A reversing rolling apparatus according to the present invention includes a first and a second coiling-uncoiling units supported by a common frame, disposed between a reversing rolling mill for cold rolling steel strips and a joining unit for joining the trailing end portion of a preceding steel strip un-coiled by a uncoiling unit to the leading end portion of a following steel strip directly or via a dummy strip, or for joining dummy strips to end portions of a steel strip so that positions of both the coiling-uncoiling units are to be switchable.

7 Claims, 5 Drawing Sheets

REVERSING COLD ROLLING APPARATUS

BACKGROUND OF THE INVENTION

1. Field of the Invention

The present invention relates to a reversing cold rolling apparatus for manufacturing stainless steel sheets, silicon steel sheets, etc., using a reversing cold rolling mill.

2. Description of the Related Art

When materials that are highly resistant to deformation such as stainless steel sheets or silicon steel sheets are cold rolled, reversing rolling is generally carried out thereon by using a small-roller rolling mill such as Sendzimir Mill. That is, as shown in FIG. 1B, a steel strip 14 is repeatedly rolled to be formed into a predetermined thickness while being uncoiled and coiled several times between a pair of coiling-uncoiling units 11 and 12.

However, during the uncoiling of a steel strip, since several number of turns of the coiled steel strip 14, in a longitudinal end portion (referred to as an end portion below), are always needed to be left on mandrels of the coiling-uncoiling units 11 and 12 for maintaining proper strip tension, unrolled portions coiled all the way, are produced that is a faulty portion called "an unrolled portion" by adding thereto a partial length of a steel strip 14 corresponding to the path between the coiling-uncoiling unit and the place directly below operating rollers.

Accordingly, in order to minimize this faulty portion, a coil preparatory line, a pre-rolling process, is conventionally arranged separately, in which dummy strips known as "leader strips" are welded to both ends of a steel strip or ends of steel strips are welded to be connected to each other directly or via a dummy strip to increase the steel strip length. This is done so that the faulty portion is reduced, which leads to improvements in yield, etc.

The coil preparatory line may also often includes a side trimmer for cutting off strip edges that to remove faulty portions located in the lateral end portions (referred to as an edge portion below) of a steel strip or to adjust the lateral length of a steel strip.

Structural examples of the above-mentioned coil preparatory line and a rolling line will be now described. As shown in FIG. 1A, the coil preparatory line is formed of an uncoiling unit 1 for un-coiling steel strips 10, a rough leveler 2 for modifying roll sets of the steel strips 10, a shear 3 for cutting off end portions of the steel strips 10 for welding, a dummy strip supplying unit 4 for supplying dummy strips (not shown), a welder 5 for welding end portions of the steel strips 10 to each other or welding an end portion of the steel strip 10 to an end portion of the dummy strip, a grinder 6 for grinding welded portions so as to smooth the surfaces thereof, a side trimmer 7 for cutting off edge portions of the steel strip 10, masher rollers 8 for smoothing burrs in the cutting surfaces produced by the side trimmer 7, and a coiling unit 9 for coiling the steel strip 10.

A pair of deflector-pinch rollers 30 are also illustrated in the drawing.

The above-mentioned shear 3, the dummy strip supplying unit 4, the welder 5, and the grinder 6 form a joining unit according to the present invention. The grinder 6 is not an essential component of the joining unit. The side trimmer 7 and the masher rolls 8 are also not compulsory components of the joining unit.

As shown in FIG. 1B, the rolling line is formed of a coiling-uncoiling unit 11 in the inlet side, a rolling mill 13, and a coiling-uncoiling unit 12 in the outlet side. Deflector rollers 15 are also illustrated in the drawing.

However, since the coil preparatory line and the cold rolling line have been conventionally independent of each other, the following problems as described below in items (1) to (4) are involved.

(1) The coil preparatory line and the reversing cold rolling line are required to have respective workers assigned to them.

(2) These lines require handling operations that the steel strip completed with operating in the coil preparatory line is coiled, for a time, in the coiling unit located in the outlet side of the coil preparatory line to be transferred out of the line for tentative storing on a coil yard; then, one of the waiting steel strips on the coil yard is set on the coiling-uncoiling unit in the cold rolling line to be fed in the rolling line.

In addition, in the cold rolling line, that has a delivering unit disposed in the inlet side for reducing the down time (set-up time) of the line, the steel strips tentatively waiting on the coil yard, are set on the delivering unit.

(3) Since both the coil preparatory line and the reversing cold rolling line are independent of each other, ineffective processes such as coiling and delivering are repeated, and plural coils have to be treated in the coil preparatory line, in advance while waiting in a predetermined place so that the next coil can be fed to the rolling line just after a preceding coil is completed rolling.

(4) The steel strips are likely to be damaged during he handling operations.

In order to solve the above-mentioned problems, a single line may be proposed, in which the coil preparatory line and the reversing cold rolling line are simply united in series, i.e., after welding steel strips to each other or welding between a steel strip and a dummy strip, rolling can be successively performed. However, this line has the following problems.

(5) Since a steel strip has to be stopped during welding operations, rolling operations should be also stopped, resulting in reduced productivity in rolling operations.

(6) The distance from the uncoiling unit to the operating rollers is increased, therefore the length of the dummy strip is increased to that extent, requiring a larger-scale dummy strip supplying unit and increased cost in accordance with increased length of the dummy strip.

(7) Arranging plural rolling mills in series to replace reversing rolling with one-way rolling can be considered; however, the cost of equipment is increased.

Therefore, any single line, in which the coil preparatory line and the reversing cold rolling line are united, has not been built yet because of the reasons of items (1) to (7).

SUMMARY OF THE INVENTION

In view of the above-described problems, the present invention has been made. Accordingly, it is an object of the present invention to solve the problems by unifying the coil preparatory line and the reversing cold rolling line without reducing the efficiency of the rolling operation.

In order to solve the above-described problems, a cold rolling apparatus provided by the present invention comprises an uncoiling unit for un-coiling steel strips; a joining unit for joining a steel strip to at least one of another steel strip and a dummy strip, the joining unit disposed downstream of the uncoiling unit; a first coiling-uncoiling unit for coiling and un-coiling steel strips, the first coiling-uncoiling unit disposed downstream of the joining unit; a reversing rolling mill for cold rolling steel strips, the reversing rolling mill disposed downstream of the first coiling-uncoiling unit;

a second coiling-uncoiling unit for coiling and un-coiling steel strips, the second coiling-uncoiling unit disposed upstream of the reversing rolling mill; a third coiling-uncoiling unit for coiling and un-coiling steel strips, the third coiling-uncoiling unit disposed downstream of the reversing rolling mill; and interchanging means for switching the positions of the first coiling-uncoiling unit and the second coiling-uncoiling unit by moving the first coiling-uncoiling unit and the second coiling-uncoiling unit linked together.

According to the present invention, during cold rolling of a preceding steel strip, a following steel strip is joined at the end portions to the dummy strips, etc., independently of this cold rolling operation, i.e., without stopping the rolling mill, and then coiled by the first coiling-uncoiling unit.

When the cold rolling operation is completed and a preceding steel strip is coiled by the third coiling-uncoiling unit, switching of the first coiling-uncoiling unit to the second coiling-uncoiling unit and switching of the second coiling-uncoiling unit to the first coiling-uncoiling unit are performed by the interchanging means. Thereby, conventional handling operations with following steel strips as described above are simplified.

That is, a cold rolling apparatus according to the present invention has an effect that the coil preparatory line and the reversing rolling line can be unified without reducing the efficiency of the cold rolling operation.

DESCRIPTION OF THE PREFERRED EMBODIMENT

Figure 1B:
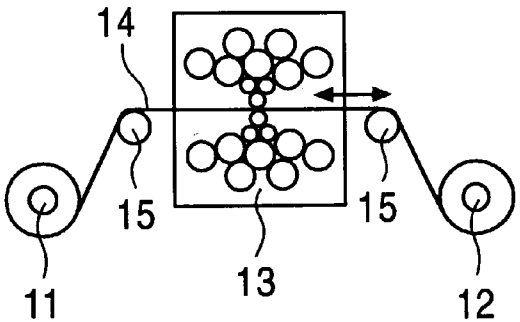
FIG. 1B is a schematic representation showing a conventional reversing cold rolling line.
Figure 1A:
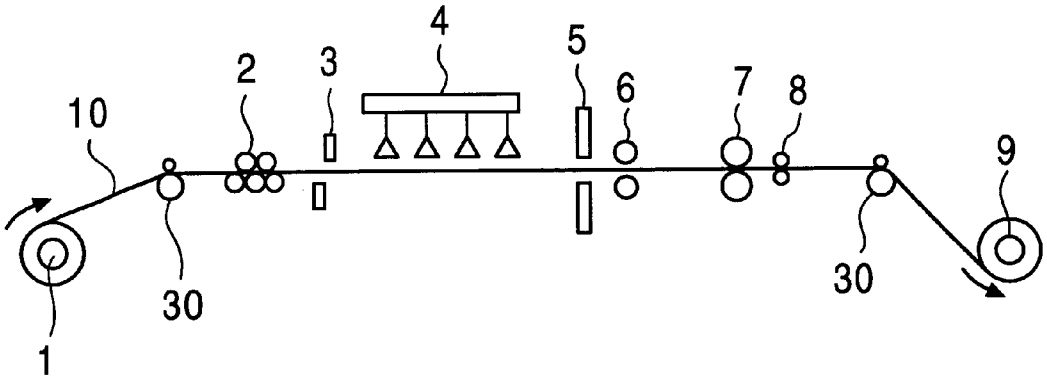
FIG. 1A is a schematic representation showing a conventional coil preparatory line.

Referring to the drawings, an embodiment of the present invention will now be described. In addition, like reference characters designate like functional portions common to the above-described conventional example (FIGS. 1A and 1B) with the description thereof omitted for brevity.

Figure 2:
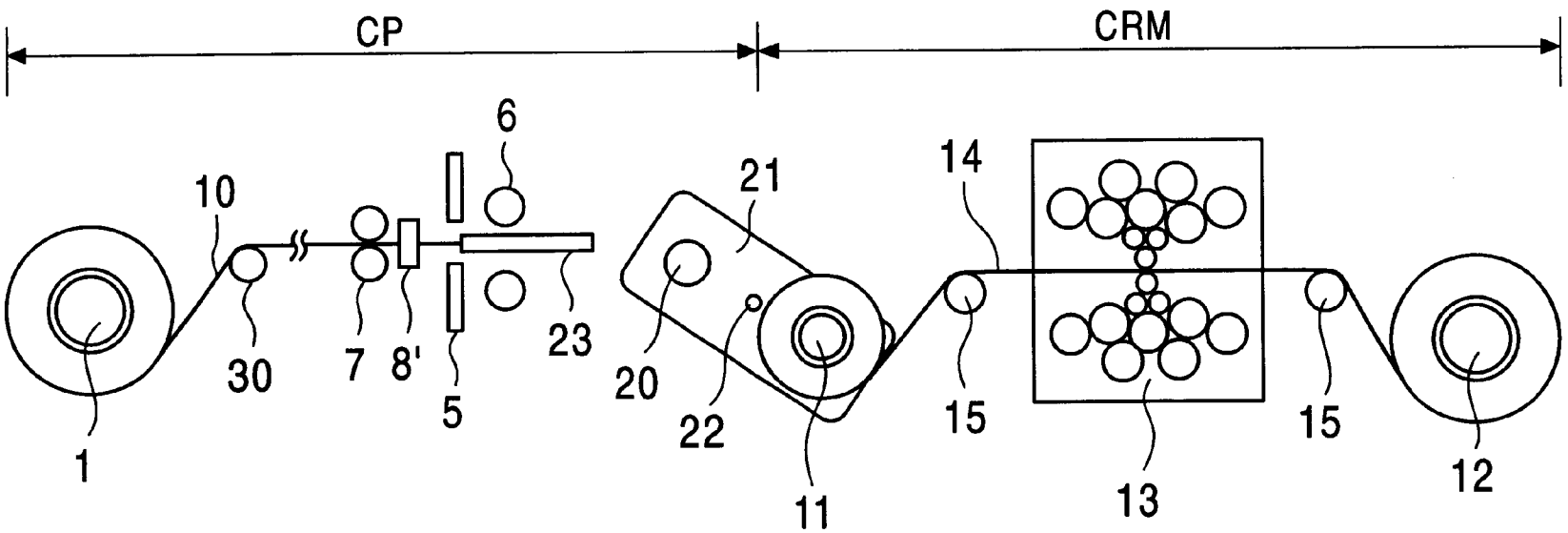
FIG. 2 is a schematic representation of a reversing cold rolling line according to an embodiment of the present invention, showing a state that a dummy strip is welded to the leading end portion of a following steel strip.

FIG. 2 illustrates a reversing cold rolling apparatus according to the embodiment of the present invention.

Although the basic configurations of the coil preparation section "CP" and the cold reverse mill section "CRM" are the same as the conventional ones, the coil preparation section "CP" and the cold reverse mill section "CRM" are joined together by connecting the coiling unit 9 in the outlet side of the conventional coil preparatory line to a second coiling-uncoiling unit 11 of the rolling line in the inlet side to form a so-called carousel-type coiling-uncoiling unit, having two coiling-uncoiling units 20 and 11.

That is, a first coiling-uncoiling unit 20 is substituted for the coiling unit 9 in the outlet side of the coil preparatory line; the first coiling-uncoiling unit 20 and a coiling-uncoiling unit 11 (referred to as a second coiling-uncoiling unit below) are supported by a common frame 21.

A rotation axis 22 is disposed at the middle point of the segmental line connecting the mandrels of the first coiling-uncoiling unit 20 and the second coiling-uncoiling unit 11 in the frame 21, and the frame 21 is to be rotated about the rotation axis 22 by an actuator such as an oil motor or an oil cylinder (not shown). The positions of the first coiling-uncoiling unit 20 and the second coiling-uncoiling unit 11 are smoothly interchangeable by the rotation of the frame 21 at a 180° angle.

Hereby, interchanging means are formed of the frame 21 and the actuator (not shown).

In order to enable the welder 5 to weld a dummy strip 23 to the leading end portion of a following steel strip 10 during rolling operation of a preceding steel strip 14, an interface dimension between the positions of the welder 5 and the first and second coiling-uncoiling units 20 and 11 is decided considering the maximum length of the dummy strip 23.

In the coil preparation section "CP" of this embodiment, as shown in FIG. 2 different from the above-described conventional example, an edge grinder 8' is arranged upstream of the welder 5 instead of the side trimmer 7 and the masher rollers 8; however, the side trimmer 7 and the masher rollers 8 (or the edge grinder 8') may be arranged downstream of the welder 5 just like the conventional example. That is, the coil preparatory line may include any other unit except for the conventional coiling unit 5 in the outlet side.

Then, operations, etc., of the cold rolling apparatus formed as described above will be described.

Figure 3:
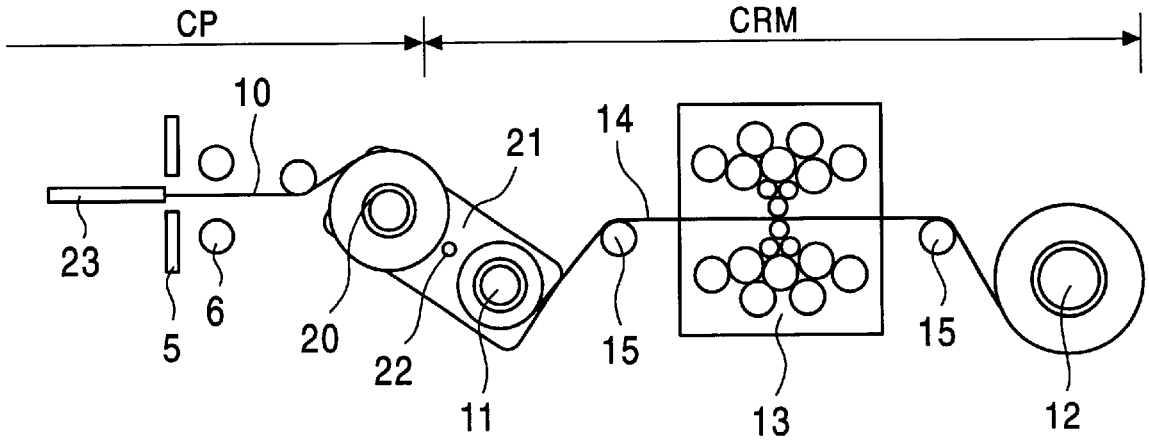
FIG. 3 is a schematic representation of a cold rolling line according to the embodiment of the present invention, showing a state that a dummy strip is welded to the trailing end portion of a following steel strip.

During reverse rolling of a preceding steel strip 14 in the rolling mill 13 by repeated coiling and uncoiling of the preceding steel strip 14 between the second coiling-uncoiling unit 11 and a third coiling-uncoiling unit 12 via the rolling mill 13 in the rolling section "CRM", a following steel strip 10 is un-coiled independently of this rolling operation just like the conventional operation by the uncoiling unit 1 and welded at the leading end portion thereof to a dummy strip 23 (see FIG. 2) to be coiled in the first coiling-uncoiling unit 20 one after another and furthermore a dummy strip 23 is welded to the trailing end portion of the steel strip 10 (see FIG. 3) to be coiled in the first coiling-uncoiling unit 20, completing the coil preparatory operation in which dummy strips are welded to the end portions of the steel strip 10.

The coil preparation section "CP" and the cold reverse mill section "CRM" are joined together in this manner, the leading and trailing end portions of a following steel strip 10 can be welded to dummy strips 23 without reducing the efficiency of rolling operation of a preceding steel strip 14, i.e., without stopping the rolling mill for welding of the dummy strips 23.

Figure 4B:
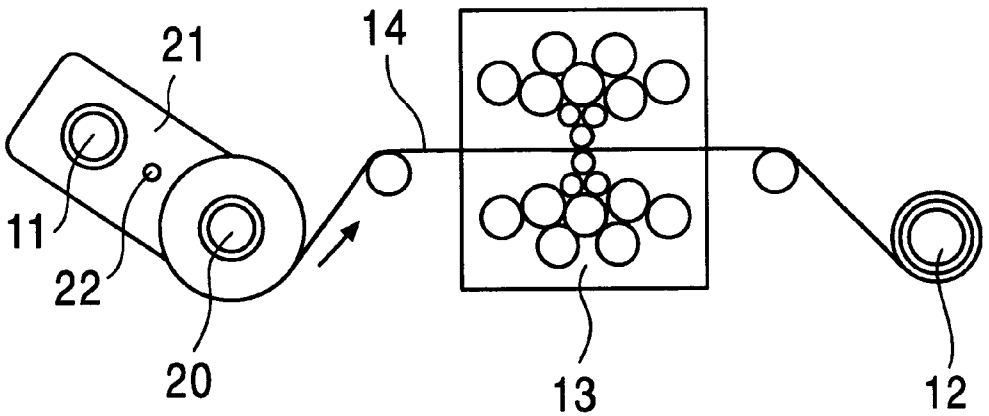
FIG. 4B is a schematic representation of switching from the first coiling-uncoiling unit to the second coiling-uncoiling unit, showing a state that a following steel strip starts rolling operation after the switching of the coiling-uncoiling units.
Figure 4A:
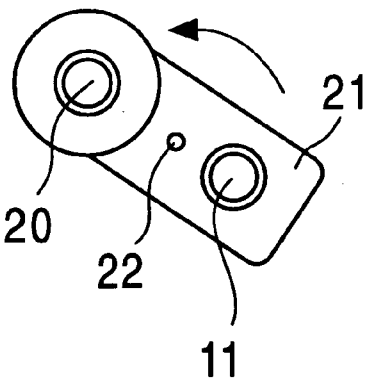
FIG. 4A is a schematic representation of switching from the first coiling-uncoiling unit to the second coiling-uncoiling unit, showing a state that a preceding steel strip has finished rolling operation.

Furthermore, when the rolling operation of a preceding steel strip 14 is completed and the steel strip 14 is coiled by the third coiling-uncoiling unit 12, as shown in FIG. 4A and 4B, the first and second coiling-uncoiling units 20 and 11 are interchanged to each other, i.e., the first coiling-uncoiling unit 20 is moved to the second coiling-uncoiling unit 11 and vice versa, by the rotation of the frame 21 at a 180° angle.

A new steel strip 14 in the first coiling-uncoiling unit 20 is consecutively un-coiled and strip-passing operation to the third coiling-uncoiling unit 12 via the rolling mill 13 is performed, so that new rolling operation is started.

In this manner, the set-up time, i.e., the line down time, which is an important factor controlling efficiency of the rolling operation, can be established at a similar level to a conventional time by an independent rolling line.

That is, when the coil preparation section "CP" and the cold reverse mill section "CRM" are simply connected together, an additional line down-time is produced by welding a dummy strip to the trailing end portion of a preceding steel strip being rolled, before completion of the first rolling pass of the preceding steel strip. On the other hand, the above-mentioned additional line downtime cannot be generated by connecting a dummy strip to the trailing end portion of a following steel strip during rolling of a preceding steel strip using a rotational frame as the one in the present invention. Since a following steel strip 10 with dummy strips 23 welded thereto in the coil preparation section "CP" is incorporated into the cold reverse mill section "CRM" by only rotation of the frame 21, the transitional operation of steel strips 10 from the coil preparation section "CP" to the cold reverse mill section "CRM" can be simply and smoothly made. Furthermore, since coils are not needed to be removed from the mandrel of the coiling-uncoiling unit 20 for a time to set them in another unit or to place them on a waiting area (a coil yard) for a time, damage possibilities of steel strips during transition from the coil preparation section "CP" to the cold reverse mill section "CRM" are substantially reduced.

By arranging a side trimmer for cutting off edge portions of steel strips, masher rollers for smoothing burrs in cutting surfaces produced by cutting off by the side trimmer, or a grinder for grinding welded portions so as to smooth the surfaces thereof, in the coil preparation section "CP", damages in operating rollers of the rolling mill 13 owing to burrs of the edge portions after trimming or beads of welded portions can be prevented. This results in satisfactory cold rolling operation even if the coil preparation section "CP" and the reverse mill section "CRM" are united.

Although the case that end portions of a following steel strip 10 are welded to dummy strips 23 in the coil preparation section "CP" has been described above (FIG. 3), the coil preparation process may be performed by welding end portions of steel strips 10 among themselves directly or via a dummy strip 23 to increase the steel strip length.

The interchanging means for switching the first coiling-uncoiling unit 20 and the second coiling-uncoiling unit 11 is not limited to the structure in that both the coiling-uncoiling units 11 and 20 are supported by the common frame 21 as mentioned above and may be formed by other mechanisms as long as the mechanism can switch positions of both the coiling-uncoiling units 11 and 20 linking them together.

Figure 5:
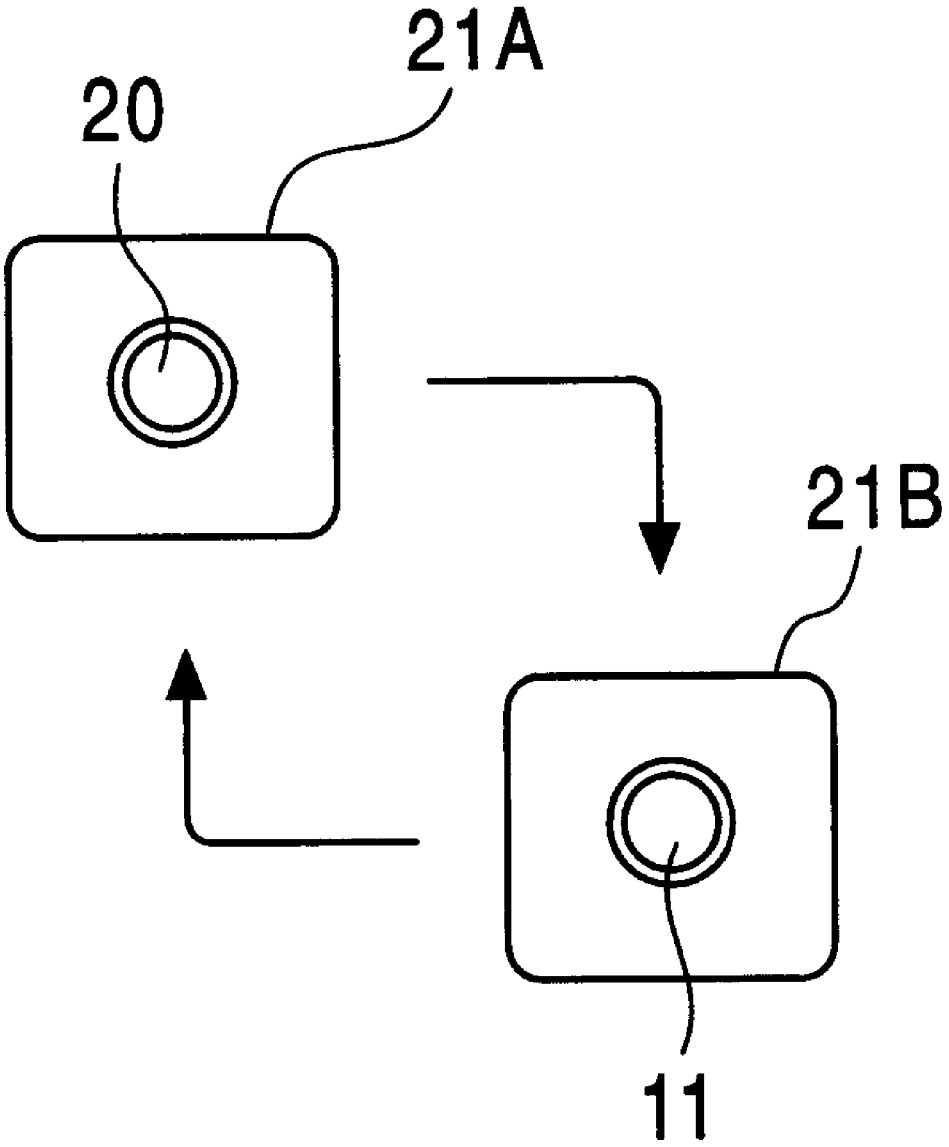
FIG. 5 is a schematic representation showing another switching means for switching the coiling-uncoiling units.

For example, the first coiling-uncoiling unit 20 and the second coiling-uncoiling unit 11 may be supported by respective frames 21A and 21B as shown in FIG. 5, so that each of the frames 21A and 21B is moved along the arrow directions indicated in FIG. 5 by guiding means and an actuator (not shown), or so that both the frames 21A and 21B are rotated linking them together so as to interchange positions of the first coiling-uncoiling unit 20 and the second coiling-uncoiling unit 11.

In addition, a first steel strip in the beginning of operation may be directly passed to the rolling mill 13 side to be coiled to the third coiling-uncoiling unit 12 without using the first and second coiling-uncoiling units 20 and 11.

In the above-described embodiment, the case of an even number of rolling passes is described; however, an odd number of rolling passes may be adopted of course. In this case, a steel strip given coil preparatory treatment is rolled in the rolling mill 13 while being reciprocated between the second coiling-uncoiling unit 11 and the third coiling-uncoiling unit 12, so as to be coiled in the second coiling-uncoiling unit 11 after completion of rolling.

As described above, a cold rolling apparatus according to the present invention has an effect that the coil preparation section and the cold reverse mill section can be unified without reducing cold rolling efficiency.

By unifying the coil preparation line and the reverse rolling line, the following effects are produced.

(1) Even when the delivering unit in the rolling line is omitted, the set-up time in the rolling line does not increase, i.e., the delivering unit can be omitted without decreasing efficiency, thereby reducing construction costs.

(2) The number of workers can be reduced by unifying both the coil preparation line and the reverse rolling line.

(3) Plural steel strips given treatment in the coil preparatory line do not need to wait for rolling.

(4) Since the coil transition from the coil preparation line to the rolling line is performed while the coil remains inserted into the same mandrel of the coiling-uncoiling unit, possibilities of coil damages during the transition are substantially decreased.

With these features, the transition operation of coils from the coil preparation section to the rolling section can be effectively simplified.

Furthermore, with these features, even when the coil preparation line and the rolling line are unified, satisfactory rolling operation can be performed without damaging the operation rollers of the rolling mill.

What is claimed is:

1. A cold rolling apparatus comprising:

an uncoiling unit that uncoils at least one steel strip;

a joining unit that joins each of a leading end portion and a trailing end portion of the at least one steel strip to a dummy strip, the joining unit being disposed downstream of said uncoiling unit;

a first coiling-uncoiling unit that coils and uncoils the at least one steel strip and dummy strips, said first coiling-uncoiling unit being disposed downstream of said joining unit;

a reversing rolling mill that cold rolls the at least one steel strip, said reversing rolling mill being disposed downstream of said first coiling-uncoiling unit;

a second coiling-uncoiling unit that coils and un-coils the at least one steel strip and dummy strips, said second coiling-uncoiling unit being disposed upwardstream of said reversing rolling mill;

a third coiling-uncoiling unit that coils and un-coils the at least one steel strip and dummy strips, said third coiling-uncoiling unit being disposed downstream of said reversing rolling mill; and an interchanging device that switches respective positions of said first coiling-uncoiling unit and said second coiling-uncoiling unit by moving said first coiling-uncoiling unit and said second coiling-uncoiling unit which are linked together.

2. The cold rolling apparatus according to claim 1, wherein the interchanging device includes a movable common frame that supports said first coiling-uncoiling unit and said second coiling-uncoiling unit.

3. The cold rolling apparatus according to claim 1, wherein the joinging unit performs at least one of:

wherein the at least one one steel strip is a preceding steel strip that has a trailing end portion and that is uncoiled by the uncoiling unit, and another steel strip is a following steel strip that has a leading end portion, joining the trailing end portion of the preceding steel strip to the leading end portion of the following steel strip, the joining being accomplished by at least one of directly joining the preceding and succeeding steel strips and joining the preceding and succeeding steel strips via the dummy strip.

4. The cold rolling apparatus according to claim 1, wherein said joining unit includes a shearing device that cuts the leading and trailing end portions of the at least one steel strip, and a dummy strip supplying unit that supplies the dummy strips.

5. The cold rolling apparatus according to claim 3, further comprising:

at least two steel strips, wherein the at least two steel strips, the another steel strip, and the dummy strips include joined portions, said joining unit further including a grinder that grinds the joined portions.

6. The cold rolling apparatus according to claim 5, wherein a joining of the at least two steel strips, the another steel strip and the dummy strips forms at least one of an edge portion and burrs, said joining unit further including at least one of a side trimmer that cuts off the edge portion and masher rollers that smooth the burrs.

7. The cold rolling apparatus according to claim 6, wherein said joining unit further includes an edge grinder.

* * * * *